US007837025B2

(12) United States Patent
Draghetti et al.

(10) Patent No.: US 7,837,025 B2
(45) Date of Patent: Nov. 23, 2010

(54) CENTRING DRUM FOR FILTER ASSEMBLY MACHINES

(75) Inventors: Fiorenzo Draghetti, Medicina (IT); Gianluca Bertinelli, Anzola Dell'Emilia (IT); Umberto Zanetti, Modena (IT); Alessandro Gobbi, Anzola Dell'Emilia (IT)

(73) Assignee: G.D. Societa' per Azioni, Bologna (IT)

( * ) Notice: Subject to any disclaimer, the term of this patent is extended or adjusted under 35 U.S.C. 154(b) by 873 days.

(21) Appl. No.: 10/579,589

(22) PCT Filed: Nov. 16, 2004

(86) PCT No.: PCT/EP2004/052981

§ 371 (c)(1),
(2), (4) Date: Mar. 12, 2007

(87) PCT Pub. No.: WO2005/046366

PCT Pub. Date: May 26, 2005

(65) Prior Publication Data

US 2007/0251533 A1 Nov. 1, 2007

(30) Foreign Application Priority Data

Nov. 17, 2003 (IT) ..... B02003A0683

(51) Int. Cl.
*A24C 5/00* (2006.01)
*A24C 5/47* (2006.01)

(52) U.S. Cl. ..... 198/471.1; 198/469.1; 131/94

(58) Field of Classification Search ..... 198/471.1, 198/438; 131/94
See application file for complete search history.

(56) References Cited

U.S. PATENT DOCUMENTS

| | | | | |
|---|---|---|---|---|
| 4,640,013 | A * | 2/1987 | Cristian | 131/94 |
| 5,984,851 | A | 11/1999 | Irikura | |
| 2004/0237972 | A1 | 12/2004 | Horn et al. | |
| 2004/0255963 | A1 | 12/2004 | Focke et al. | |

FOREIGN PATENT DOCUMENTS

| | | |
|---|---|---|
| EP | 0 693 257 | 1/1996 |
| EP | 1 138 215 | 10/2001 |
| WO | 03/024256 | 3/2003 |
| WO | 03/043449 | 5/2003 |

* cited by examiner

*Primary Examiner*—Gene Crawford
*Assistant Examiner*—Kavel P Singh
(74) *Attorney, Agent, or Firm*—Ladas & Parry LLP

(57) ABSTRACT

A centring drum for filter assembly machines, the centring drum having external axial seats movable with the centring drum about a longitudinal axis of rotation, and for receiving respective double filters, at least some of which are offset laterally, along the relative seats, with respect to a central transverse reference plane; each seat housing a respective stop member movable with the relative seat about the longitudinal axis of rotation, and located on a respective side of the reference plane to define a centred position of the relative double filter, and a push device for moving the relative double filter axially onto the relative stop member; the stop members defining a first and a second succession of stop members, which are located on opposite sides of the reference plane and are both connected to a position adjusting device movable about the longitudinal axis of rotation and for moving the two successions equally and oppositely along the longitudinal axis of rotation.

10 Claims, 3 Drawing Sheets

CENTRING DRUM FOR FILTER ASSEMBLY MACHINES

TECHNICAL FIELD

The present invention relates to a centring drum for filter assembly machines.

BACKGROUND ART

On filter assembly machines, filter portions, of a length equal to that of an even number of filters, normally four or six, are fed into a hopper, from which they are withdrawn by an extracting drum having a number of peripheral seats equally spaced about the extracting drum and for receiving and retaining respective filter portions by suction. Each of the filter portions is fed by the extracting drum through a cutting station where it is cut into a number of shorter filter portions defining respective double filters, i.e. twice the length of a cigarette filter, positioned coaxially inside the respective seat.

The double filters in each number are then transferred to an offsetting drum, which offsets them angularly with respect to one another to form, along its periphery, a number of rows of double filters equal to the number of double filters formed from each filter portion. The double filters in each row are equally spaced with a first spacing, which is equal for all the rows, about the axis of the offsetting drum, and each double filter in each row is offset, with respect to a corresponding double filter in an adjacent row, by a second spacing equal to a submultiple of the first spacing.

The offset double filters are then fed to a centring drum, which shuffles the rows, by shifting them laterally, into a single row in which the double filters are spaced with said second spacing. This single row is then fed in known manner to a feed line supplying cigarette portions, to form double cigarettes.

On known centring drums, the rows are normally shuffled by means of fixed external converging plates, which gradually engage the rows of double filters, and slide the double filters axially along the relative seats into alignment with one another and into a central position normally centred with respect to a reference plane crosswise to the rotation axis of the centring drum.

Though perfectly functional, known centring drums of the type described above have drawbacks when making any change in format, which normally involves changing and/or dismantling and reassembling said plates, thus resulting in relatively prolonged downtime.

DISCLOSURE OF INVENTION

It is an object of the present invention to provide an improved centring drum designed to eliminate the aforementioned drawback.

According to the present invention, there is provided a centring drum as claimed in claim 1 and, preferably, in any one of the following Claims depending directly or indirectly on claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Number 1 in the accompanying drawings indicates as a whole a substantially cylindrical centring drum mounted for rotation about a respective longitudinal axis 2, and which provides for receiving two side by side rows 3 and 4 of double filters 5—which rows are located on opposite sides of a substantially central reference plane T crosswise to longitudinal axis 2, and are offset angularly about axis 2—and for shuffling the two rows 3 and 4 through reference plane T to form a single row 6 centred with respect to reference plane T and comprising a succession of double filters 5 positioned parallel to axis 2 and spaced about axis 2 with a spacing equal to half the spacing of double filters 5 in rows 3 and 4.

Figure 1:
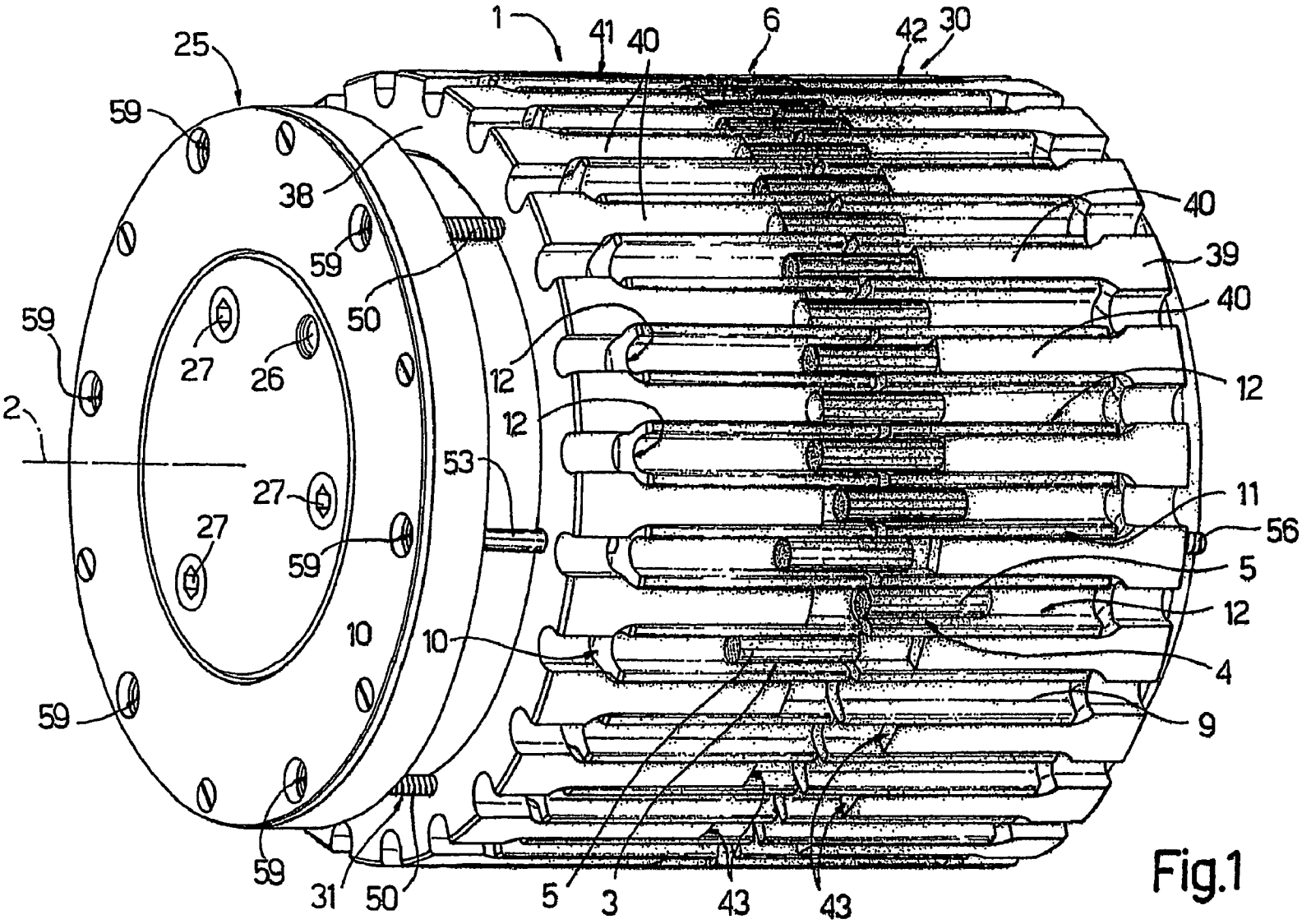
FIG. 1 shows a schematic view in perspective of a preferred embodiment of the centring drum according to the present invention.
Figure 2:
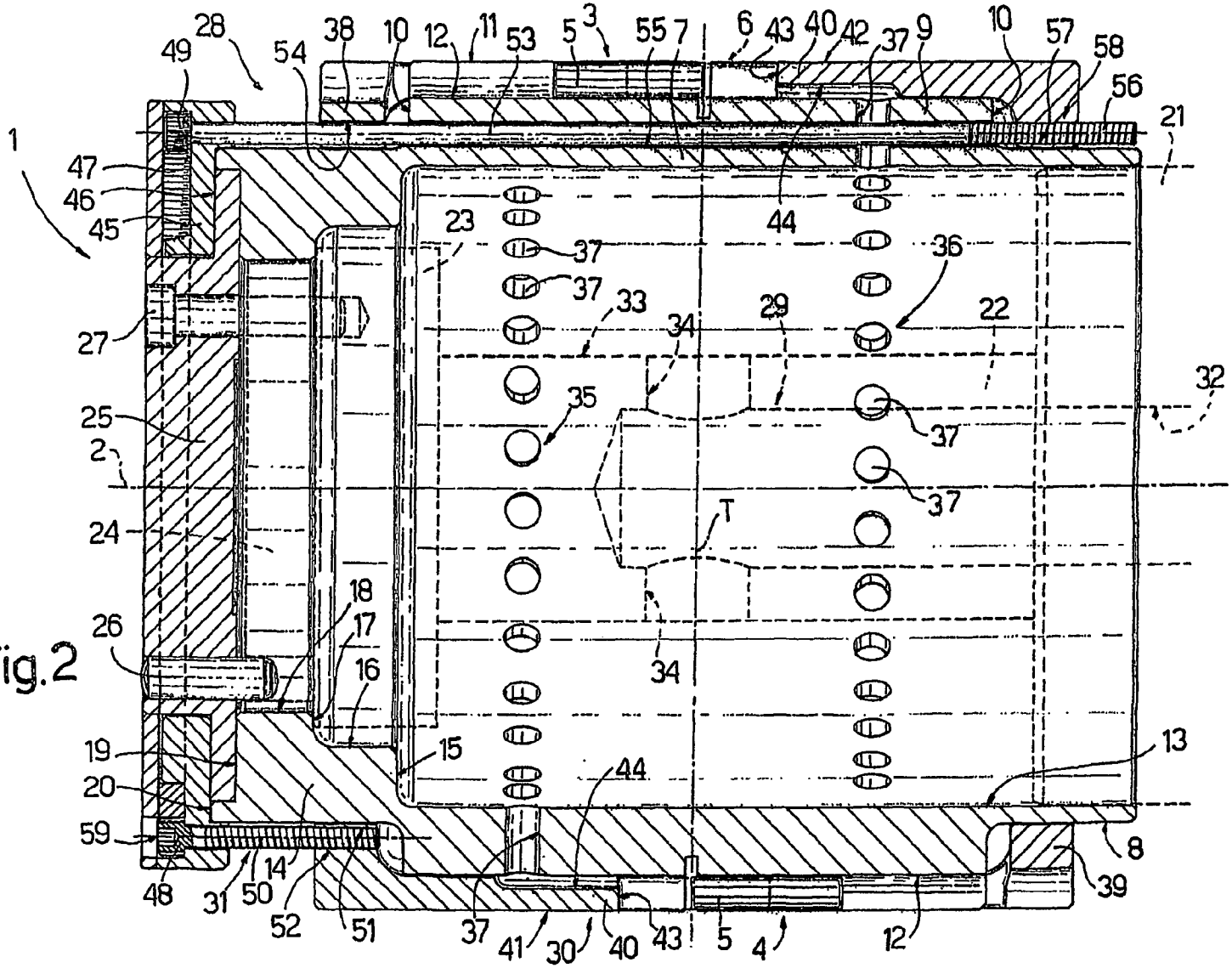
FIG. 2 shows a substantially axial section of the FIG. 1 centring drum.
Figure 3:
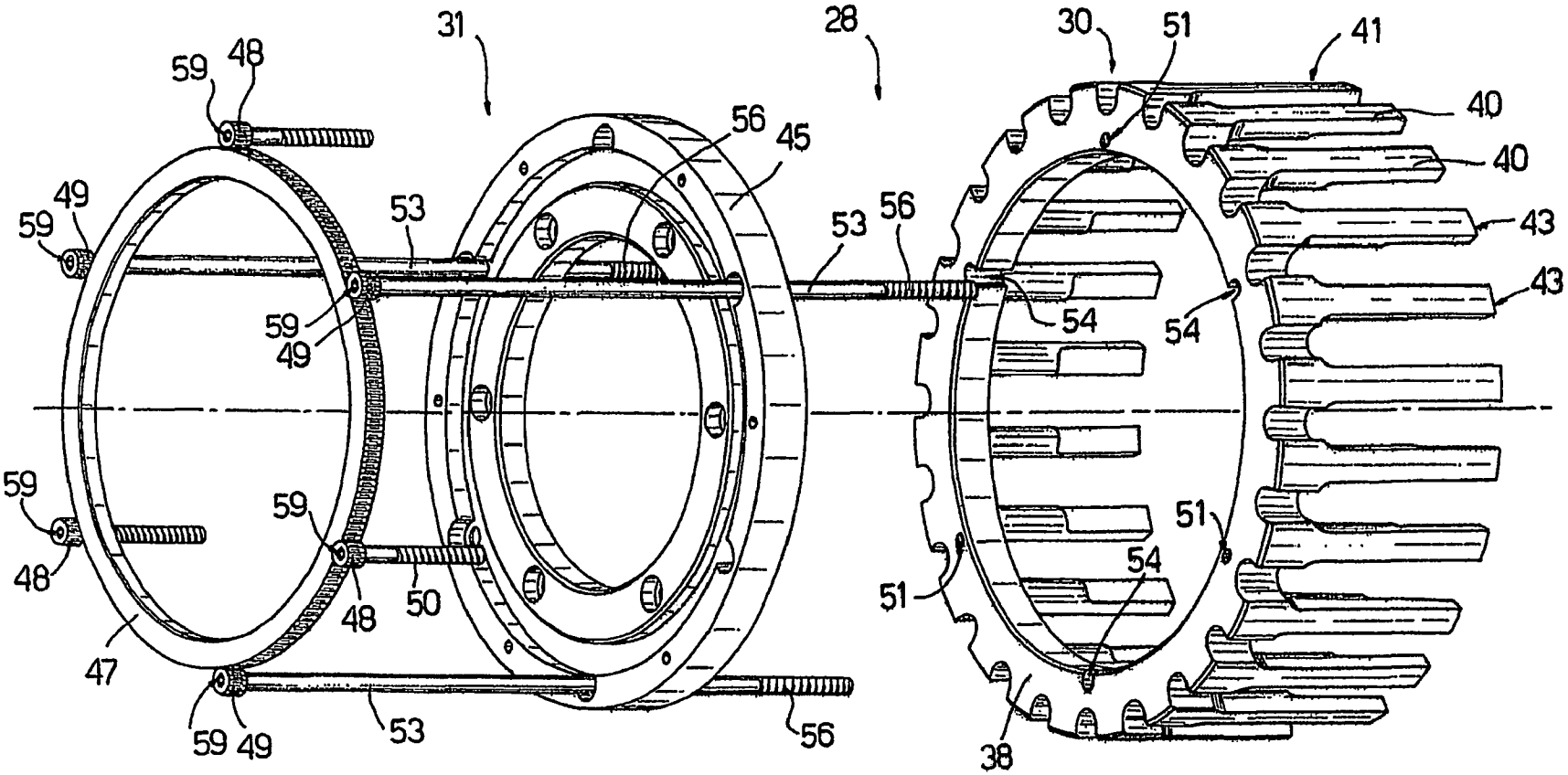
FIG. 3 shows an exploded view in perspective of a detail in FIGS. 1 and 2.

As shown more clearly in FIG. 2, centring drum 1 comprises a substantially cylindrical shell 7 coaxial with longitudinal axis 2, rotating about longitudinal axis 2, and through which reference plane T extends. Externally, shell 7 comprises a cylindrical surface 8, a central portion of which is fitted with a larger-diameter sleeve 9 centred with respect to reference plane T, bounded axially by two annular shoulders 10, and bounded externally by a cylindrical surface 11 coaxial with longitudinal axis 2 and having a number of substantially semicylindrical-section grooves 12, each defining a seat for a relative double filter 5. More specifically, grooves 12 are parallel to longitudinal axis 2, are equally spaced about longitudinal axis 2, extend through reference plane T, and each receive a respective double filter 5 originally located entirely on one side of reference plane T. That is, if two adjacent grooves 12 are considered in the example shown, the relative double filters 5 are originally located on opposite sides of reference plane T.

As shown in FIG. 2, shell 7 is open at the rear, comprises a cylindrical inner surface 13 coaxial with longitudinal axis 2, and is bounded at the front by an end wall 14 having an inner surface 15, through which is formed a cylindrical cavity 16 coaxial with longitudinal axis 2 and in turn comprising an end surface 17 having a through hole 18. Hole 18 is coaxial with longitudinal axis 2, and connects cavity 16 to a cavity 19 formed in an outer surface 20 of end wall 14.

A rear portion of inner surface 13 is fitted inside in fluidtight manner with the end of a drive shaft 21 having an axial end appendix 22, the free end of which is fitted with a cylindrical head 23 resting against end surface 17 of cavity 16 and having a cylindrical centring appendix 24 shorter in length than hole 18, and the outer surface of which mates with the inner surface of hole 18.

Drive shaft 21 is connected angularly to shell 7 by means of a cylindrical plate 25 located frontwards of end wall 14, and which is housed partly inside cavity 19, is fixed angularly with respect to drive shaft 21 by means of a pin 26, and is connected to head 23 by axial screws 27 which grip end wall 14 between head 23 and plate 25.

As shown in FIG. 2, the shell is associated with a centring device 28 comprising a suction circuit 29, a stop device 30, and an adjusting device 31 for adjusting stop device 30.

Suction circuit 29 comprises a known suction pump (not shown), the inlet of which is connected to a dead conduit 32 formed along drive shaft 21 and axial appendix 22, coaxially with longitudinal axis 2; a chamber 33 defined, inside shell 7 and about axial appendix 22, between the end of drive shaft 21 and end wall 14, and connected to conduit 32 by radial holes 34; and two rings 35 and 36 of radial holes 37 formed through shell 7 and sleeve 9, and each communicating with a respective groove 12. The two rings 35 and 36 are located on opposite sides of reference plane T, and at a distance from reference plane T greater than the length of the longest double filter 5 that can be accommodated on centring drum 1; and holes 37 in each ring 35, 36 are spaced about longitudinal axis 2 with a spacing equal to twice the spacing of grooves 12, and are offset, with respect to holes 37 in the other ring 36, 35 and about longitudinal axis 2, by a spacing equal to the spacing of grooves 12. Consequently, if one groove 12 communicates with a hole 37 in ring 35, the two adjacent grooves 12 communicate with respective holes 37 in ring 36.

Stop device 30 comprises two rings 38 and 39, which are fitted idly to the portions of shell 7 projecting outwards of sleeve 9, with ring 38 interposed between reference plane T and plate 25 and located on the opposite side of ring 35 to reference plane T, and have respective axial fingers 40, each of which extends from relative ring 38, 39 towards the other ring 39, 38, engages in axially sliding manner a respective groove 12, at the end of groove 12 having relative hole 37, and is less than half the length of groove 12, but long enough to cover relative hole 37 in any operating condition. Consequently, fingers 40 of rings 38 and 39 define respective successions 41, 42 of fingers 40, located on opposite sides of reference plane T; fingers 40 in each succession 41, 42 are spaced about longitudinal axis 2 with a spacing equal to twice the spacing of grooves 12, and are offset, with respect to fingers 40 in the other succession 42, 41 and about longitudinal axis 2, by a spacing equal to the spacing of grooves 12; and, if one groove 12 is engaged by a finger 40 in succession 41, the two adjacent grooves 12 are engaged by respective fingers 40 in succession 42.

In the accompanying drawings, fingers 40 are shown forming one piece with respective rings 38 and 39, but may conveniently be separate from and fixed to rings 38 and 39, for example, by screws.

Each finger 40 has an end surface 43 facing reference plane T and defining a stop surface for a relative double filter 5 housed inside relative groove 12, and has, on the side facing shell 7, an axial groove 44 which communicates with relative hole 37 in any operating condition, and which comes out through end surface 43.

Adjusting device 31 comprises an annular body 45 which is fixed inside an annular groove 46 formed on the periphery of plate 25 coaxially with longitudinal axis 2, and houses for rotation a ring gear 47 coaxial with longitudinal axis 2 and having external teeth meshing with a number of pinions 48 (three in the example shown, but which may be of any number) equally spaced about longitudinal axis 2 and having axes parallel to longitudinal axis 2, and with a number of pinions 49 (three in the example shown, but which may be of any number) equally spaced about longitudinal axis 2, having axes parallel to longitudinal axis 2, and alternating, along ring gear 47, with pinions 48.

Each pinion 48 is fitted to the end of a respective screw 50 which projects from annular body 45, in a direction parallel to longitudinal axis 2, and engages a relative threaded hole 51 formed axially in ring 38, so as to define, with ring 38, a relative screw-nut screw coupling 52.

Each pinion 49 is fitted to the end of a respective rod 53 which projects from annular body 45, in a direction parallel to longitudinal axis 2, engages a relative axial groove 54 formed in the inner surface of ring 38, engages a relative axial through hole 55 formed in the thickness of sleeve 9, and has a threaded end 56 engaging a relative threaded hole 57 formed axially in ring 39, so as to define, with ring 39, a relative screw-nut screw coupling 58.

Each pinion 48, 49 has an Allen wrench socket 59 accessible from the outside to permit manual operation of ring gear 47.

In actual use, before two rows 3 and 4 of double filters 5 are fed into respective grooves 12 on opposite sides of reference plane T on centring drum 1, adjusting device 31 is set to move rings 38 and 39 so that the distance between end surfaces 43 of relative fingers 40 and reference plane T equals half the length of the double filters 5 to be fed onto centring drum 1. In the case of centring drum 1 described, adjusting device 31 is set by manually rotating one of pinions 48, 49 in one direction or the other using an Allen wrench (not shown). Rotation of one of pinions 48, 49, in fact, rotates ring gear 47 about longitudinal axis, thus rotating all of pinions 48, 49, so that rings 38 and 39 move axially in opposite directions to adjust the position of end surfaces 43 of relative fingers 40 along relative grooves 12 and with respect to reference plane T.

Consequently, any change in format involving the use of double filters 5 of different length can be made relatively quickly, and with no need to dismantle and reassemble any part of centring drum 1.

In variations not shown, adjusting device 31 may obviously be powered in various ways, e.g. by powering one of pinions 48, 49 or, more simply, ring gear 47. In which case, adjusting device 31 may conveniently be controlled automatically by a format-change control unit on the basis of memorized format data.

Each double filter 5 fed onto centring drum 1 set as described above is positioned inside a relative groove 12, on the opposite side of end surface 43 of relative finger 40 to reference plane T and aligned transversely with the other double filters 5 in relative row 3, 4, and almost immediately is pushed axially, by the air sucked through groove 44 of relative finger 40, onto relative end surface 43 of relative finger 40 and into a position aligned transversely with the previous double filters 5 to form row 6.

The embodiment described relates to a centring drum 1 for receiving two rows of double filters 5. Obviously, in the case of more than two, e.g. three or four, rows of double filters 5, centring device 28 must be modified.

For example, in the case of three rows of double filters 5, one of the two rings 38, 39 used, e.g. ring 38, is provided with two successions of fingers 40, and the other with only one succession of fingers 40. Fingers 40 in the two successions connected to ring 38 will be of different lengths, so as to keep the double filters 5 in one of the relative two rows centred with respect to reference plane T, and to enable the double filters 5 in the other of the relative two rows to move axially into a centred position with respect to reference plane T.

In the case of four rows of double filters 5, both rings 38, 39 will be provided with two successions of fingers 40.

The invention claimed is:

1. A centering drum for filter assembly machines, the centering drum (1) comprising:

a substantially cylindrical shell (7) rotatable about a longitudinal axis (2) and defining a transverse reference plane (T);

a plurality of seats (12) formed, parallel to and equally spaced from said longitudinal axis (2), on the outside of said shell (7) each of said seats (12) being dimensioned and adapted to receive a respective filter portion (5) in an offset position offset laterally with respect to said reference plane (T); and centering means (28) for moving each filter portion (5), along the respective seat (12), from the offset position to a center position to center the filter portion with respect to said reference plane (T);

wherein the centering means (28) is fitted to said shell (7) to rotate with the shell (7) about said longitudinal axis (2), and comprises a plurality of stop members (40), each of the stop members being located adjacent to a respective seat (12) on a respective side of said reference plane (T) to define the centered position of the respective filter portion (5), and push means (29) for moving each of the filter portions (5) axially onto the respective stop member (40);

wherein the stop members (40) includes a first succession of stop members disposed on a first side of said reference plane (T) and a second succession of stop members disposed on a second side of said reference plane (T) opposite said first side, the first and second successions of stop members being alternatingly disposed on the opposite sides of said reference plane (T) such that if a first seat is engaged by a stop member of the first succession, then the adjacent seats are engaged by stop members of the second succession; and wherein adjusting means (31) is provided to move the first and second successions of stop members equally and oppositely along said longitudinal axis (2) with respect to said reference plane (T).

2. A drum as claimed in claim 1, wherein said push means (29) is pneumatic means.

3. A drum as claimed in claim 1, wherein said push means (29) is suction means which come out inside the relative said seat (12), on the same side of said reference plane (T) as the relative said stop member (40).

4. A drum as claimed in claim 1, wherein each said stop member (40) comprises a finger (40) housed in axially sliding manner inside the relative said seat (12), and having an end surface (43) facing said reference plane (T) and defining a stop surface for the relative said filter portion (5).

5. A drum as claimed in claim 4, wherein said push means (29) is suction means which come out inside the relative said seat (12) at said end surface (43).

6. A drum as claimed in claim 5, wherein said push means (29) comprises a suction hole (37) which comes out inside the relative said seat (12), beneath the relative said finger (40); and a groove (44) formed along said finger (40), communicating with the relative said suction hole (37), and terminating at said end surface (43).

7. A drum as claimed in claim 1, wherein the stop members (40) in each of the first and second successions are integral with one another.

8. A drum as claimed in claim 4, wherein said first and said second successions of stop members respectively comprise a first and a second annular body (38, 39) which are coaxial with said longitudinal axis (2), are located axially outwards of said seats (12) and on opposite sides of said reference plane (T), and connect the relative said fingers (40) to one another; said first and said second annular body (38, 39) being movable axially with respect to said shell (7), and being fitted to said adjusting means (31).

9. A drum as claimed in claim 8, wherein said adjusting means (31) comprises at least one first screw-nut screw coupling (52), in turn comprising a screw (50) extending parallel to said longitudinal axis (2), and a nut screw (51) formed through said first annular body (38); at least one second screw-nut screw coupling (58) operating in the opposite direction to said first screw-nut screw coupling (52), and in turn comprising a screw (56) extending parallel to said longitudinal axis (2), and a nut screw (57) formed through said second annular body (39); and a ring gear (47) coaxial with said shell (7) and mounted to rotate, with respect to said shell (7), about said longitudinal axis (2); each said screw (50; 56) being fitted integrally with a relative pinion (48; 49); each said pinion (48; 49) meshing with said ring gear (47), and actuating means (59) being provided to impart to said ring gear (47) a given, adjustable rotation about said longitudinal axis (2).

10. A drum as claimed in claim 1, wherein said filter portions (5) are double filters (5) for cigarettes.

* * * * *